US006609376B2

(12) United States Patent
Rokke

(10) Patent No.: US 6,609,376 B2
(45) Date of Patent: Aug. 26, 2003

(54) DEVICE IN A BURNER FOR GAS TURBINES

(75) Inventor: Nils A. Rokke, Trondheim (NO)

(73) Assignee: Ulstein Turbine AS, Bergen (NO)

( * ) Notice: Subject to any disclaimer, the term of this patent is extended or adjusted under 35 U.S.C. 154(b) by 0 days.

(21) Appl. No.: 10/169,078

(22) PCT Filed: Feb. 14, 2000

(86) PCT No.: PCT/NO01/00052

§ 371 (c)(1),
(2), (4) Date: Aug. 21, 2002

(87) PCT Pub. No.: WO01/59369

PCT Pub. Date: Aug. 16, 2001

(65) Prior Publication Data

US 2003/0074885 A1 Apr. 24, 2003

(30) Foreign Application Priority Data

Feb. 14, 2000 (NO) ..... 2000 0715

(51) Int. Cl.[7] ..... F02C 7/22
(52) U.S. Cl. ..... 60/748; 60/760; 60/737
(58) Field of Search ..... 60/748, 752, 760, 60/725, 722, 737

(56) References Cited

U.S. PATENT DOCUMENTS 2,850,875 A 9/1958 Gahwyler
3,982,392 A * 9/1976 Crow ..... 60/39.23
4,603,548 A 8/1986 Ishibashi et al.
5,611,196 A * 3/1997 Wilson ..... 60/39.11

FOREIGN PATENT DOCUMENTS

| | | |
|---|---|---|
| EP | 656512 | 6/1995 |
| NO | 303551 | 7/1998 |

* cited by examiner

*Primary Examiner*—Ehud Gartenberg
(74) *Attorney, Agent, or Firm*—Dennison, Schultz & Dougherty

(57) ABSTRACT

Device in a burner for gas turbines, comprising a cylindrical housing (10) and a fuel inlet tube (16) arranged centrally within said housing, said housing (10) and fuel inlet tube (16) mutually defining an annular chamber (28). The annular chamber (28) extending into an extended diameter combustion chamber (18), having means (25) for supplying combustion air to said annular chamber (28). Radial flow swirlers (14) are provided for creating a rotational movement of the combustion air in said annular chamber. The housing (10) has a downstream restriction (20) in front of the free end of the centrally located fuel inlet tube (16), at the entrance of the combustion chamber (18), for creating a rich combustion spinning tubular swirl dominated flow of a mixture of air and fuel, with a recirculation central core, said tubular spinning flow extending into the combustion chamber (18). The fuel inlet tube (16) has a multiple of inlet nozzles (15) in an array at a distance from the free end of the tube of at least approximately 1,5 times the diameter of the fuel inlet tube. This enable low emissions of NOx and CO over a wide operating range in a low complexity, cost effective configuration.

9 Claims, 6 Drawing Sheets

DEVICE IN A BURNER FOR GAS TURBINES

The present invention relates to a device in a burner gas turbines as appears in the preamble of claim 1.

BACKGROUND OF THE INVENTION

Low emission gas turbine combustors are previously known from e.g. U.S. Pat. No. 5,816,050 and WO 9207221. The drives for low emission combustors are often counteracted by the additional cost and complexity of the injection system, the control system and the design of the combustor itself.

Not only oxides of nitrogen (NOx) must be considered but also emissions of carbon monoxide (CO), unburned hydrocarbons (UHC) and in the most severe cases also soot and other trace species. Furthermore the regulations of emissions from gas turbines are also moving into limiting the emissions in a wider operating range which poses serious problems for stability of the combustor, acoustic resonance and furthermore complexity. This is due to the nature of the most common emission control technique, lean premixed combustion (LP), which offers less stability than the traditional high emission diffusion flame combustion (DF).

In European Patent Application 656 512 (Westinghouse Electric Corporation) a device in a burner for gas turbines is described, comprising a housing with a centrally located a fuel inlet tube, surrounded by two concentric annular chambers extending into an extended diameter combustion chamber. The fuel inlet from a source of fuel is provided through the centrally located tube. Means for supplying combustion air to said annular chambers being provided with radial flow swirlers for creating contra rotating movements of the combustion air in said two annular chambers. The fuel inlet of this device is aiming directly into a primary burning zone created in a vortex at the free and of the fuel inlet tube.

This arrangement creates a short burning zone, with a very high temperature at the end of the fuel inlet tube. The short burning zone will create undesirable emissions. Further, the arrangement of two concentric annular chambers makes severe restrictions in the minimum size of this burner, together with the mere complexity of the arrangement with a multitude of injection points, swirler vanes and passages.

OBJECTS OF THE INVENTION

There is a main object of the present invention to provide for an improved burner for gas turbines.

It is a further object to provide a burner for gas turbines, which can be designed for a wide range of capacities and which can utilised within a wide range of operating conditions.

It is a still further object, to provide a simple and cost effective technology for emissions reductions.

SUMMARY OF THE INVENTION

The device according to the present invention is defined in the characterizing clause of the following independent claim 1. Preferred embodiments of the device appears from the dependent claims.

As described in the introduction, the object of the present invention is to enable low emissions of NOx and CO over a wide operating range in a low complexity, cost effective configuration.

The burner can operate as a single stage burner, or as a multi stage burner with different orientation of the secondary stage, either as a tangentially positioned venturi combustion zone or as a co-axial secondary stage of similar design.

In a first embodiment of a burner according to the invention, the air is fed through a plurality of radial extending feed channels where swirl is imposed to the air. This creates a swirling flow in the swirler cup annulus where fuel, liquid and/or gas, is fed via nozzles in the main central hub, also comprising a centrally locating spark plug for ignition at start-up. For load variations, fuel can also be supplied in the swirler. The air is swirled in the burner cup and is then forced through an converging conical outlet of the swirl cup. This configuration creates a strong swirling flow at the entrance to the main combustion zone. At the onset of combustion a vortex breakdown zone is formed with exhaust gas recirculation constituting a stable ignition source and helps in reducing emissions by lowering the reaction temperature. The gradual admixing of fuel and air through the main central gas supply acts as a aerodynamic multi stage combustion zone lowering the emissions. Furthermore, perfect mixed fuel and air mixes into the central flame at higher power settings through the mixing in the swirl feed channels. The conical outlet also has the effect of stopping flame flash-back of the premix flow due to the velocity increase it causes.

In contrast to prior art technologies, this invention promotes mixing from the central fuel injector to improve stability, but on the other hand the gradual admixing of fuel and air and the exhaust gas recirculation caused by the vortex break down reduces the reaction temperature to a level where low emissions can be achieved. Furthermore this can be achieved without any moving parts or by means of heat exposed nozzle devices.

Two further embodiments of the burner is described, one where the combustion process is divided into two separate fuel and air inlet ports, in both cases as a pilot burner providing excellent stability of the combustor system.

In the second embodiment, the secondary (or main) fuel and air inlet port is comprised of a tangentially entering venturi (Laval nozzle) to the main combustion chamber, comprising of a cylindrical tube being open at the other extreme where the hot gases leave the combustor for doing work in the subsequent turbine stages. The venturi premixing fuel and air device is also described in U.S. Pat. No. 5,638,674 and in No. 303551, but the combination of the first embodiment burner with a venturi is not describes elsewhere. In contrast to the mentioned US-patent, no moving parts are embodied in the invention and the venturi acts as the main mixing device being supported by the basic burner. The typical shortfalls of venturi premixers of low stability and limited range is thus overcome by the first embodiment of the burner which provides hot exhaust for stable ignition and that by shifting the load from the pilot to the venturi, low emissions can be achieved over a wider range.

In the third embodiment, the secondary (or main) fuel and inlet ports consists of an annular passage being coaxial to the basic pilot burner, but consists of the same elements as the basic burner. The first embodiment of the burner now comprises the central fuel injection tube and a radially extending swirler at the inlet of the main burner. The flow of the secondary burner is co-swirling to the basic burner flow. In contrast to e.g. U.S. Pat. No. 5,816,050, the flows are co-swirling and the outlet of the pilot and main burners comprise of two converging cones, giving a considerable increase in stability and exhaust flow recirculation.

BRIEF DESCRIPTION OF THE DRAWINGS

By way of example, the invention will be further described below with reference to the accompanying drawings, in which:

FIG. 7 shows an longitudinal section through a third embodiment of the invention, while

DETAILED DESCRIPTION OF THE PREFERRED EMBODIMENTS

Figure 1:
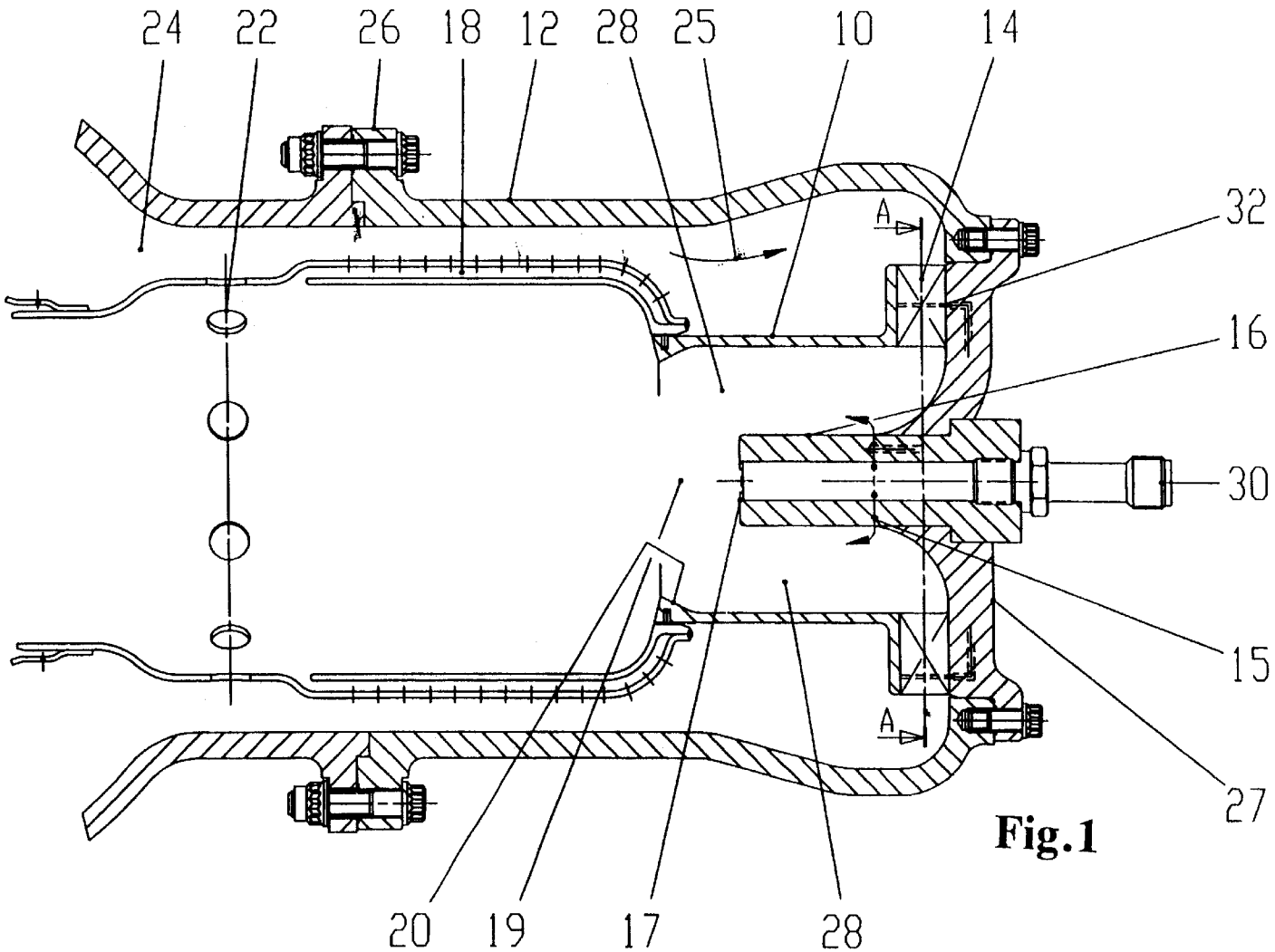
FIG. 1 shows a longitudinal section through the combustion chamber of a first embodiment of the present invention.

With reference to the enclosed FIG. 1, the basic low emission burner (the combustion chamber) according to the invention, is shown. The burner consists of a cylindrical tube 10 (or denoted a cup) positioned coaxially inside a cylindrical housing 12. The tube 10 comprises air inlet ports 14 positioned at an angle relative to a radial line starting at a central fuel inlet tube 16 hub centre. The central fuel inlet tube 16 extends into the cylindrical tube 10. The tube 16 comprises radially extending fuel outlets 15 for fuel exiting into an annular an air/fuel mixing space or annulus 28 defined between the cylindrical tube 10 and the fuel inlet tube 16. Further the fuel inlet tube 16 comprises an ignitor 30 for igniting the fuel/air-mixture, especially at the starting up procedure. The ignitor 30 extends from outside the burner through the tube 16 and towards its front end wall 17. The ratio between the diameters of the fuel inlet rube 16 and the tube 10 may preferably be 0,3–0.6. The cylindical housing 12 is connected to the carrying structure of the gas turbine by a flange 26 and bolts in known manner. The inlet end of the cylindrical housing 12 and of the tube 10 is closed by a dish 27 secured by bolts.

Figure 2:
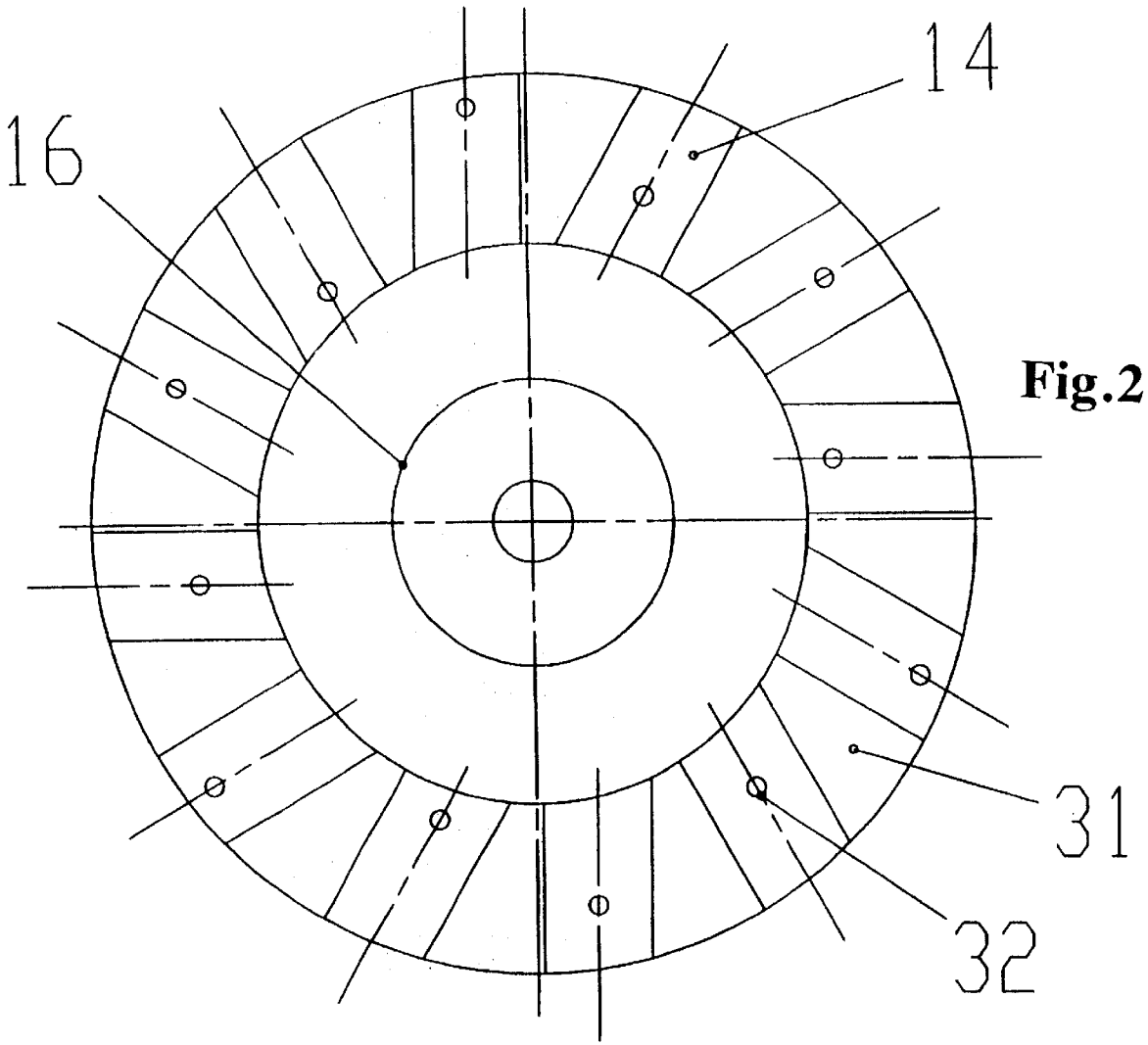
FIG. 2 shows a cross-sectional view along the line A—A of the radial swirler shown in FIG. 1.

The cylindrical tube 10 exits into a cylindrical main combustion liner 18 through a converging conical restriction 20 in the downstream end of tube 10. Thus the tangential and axial velocity of the air/fuel mixture flow increases and creates internal flue gas recirculation, providing a good ignition source for the fuel air mixture in the pilot stage. The combustion liner 18 further comprises air inlets 22 along its periphery. The combustion liner 18 and the housing 12 defines there between an annular space 24 for supply of air. A portion of this air supply is directed through said inlets 22. The arrangement of the air inlets 14 is shown in FIG. 2. The air flows through the openings 14 into the annulus 28 at an angle to the radial direction, thus creating both a radial and tangential velocity component into the annulus 28.

As also shown in figures, the inlet ports or swirlers 14 comprises an array of nozzles on spokes 32 positioned between the guide vanes 31 of the inlet ports 14. These are for the injection of fuel for mixing with the combustion air flowing through the inlet ports 14, and each nozzle may be positioned with the same or different radial position from the centre line 33 through the burner. However, as shown in FIG. 2, the radial position of the spokes 32 as measured from the centerline 33, is preferably varied and is not symmetrical, i.e. they are mutually arranged at different radius as measured from centerline 33. The purpose is to decouple any pulses of the parallel air inlet elements, for reducing the noice of the burner.

In the following the best mode of operation of this burner and the way in which the emissions are reduced, will be described.

Still referring to FIG. 1, the air enters the cylindrical tube 10 at the inlet of this stage where air, or a mixture of air and fuel, is being pumped from the engine compressor section through channels 25 and into the inlet ports 14. Fuel may optionally be added to the inlet ports 14 through the spokes 32 for mixture with the combustion air. The air or fuel/air mixture flows into the pilot stage cylindrical tube 16 having both a radial and tangential velocity component, is deflected by the central fuel inlet tube 16 and creates a flow similar to that of a free vortex, i.e. $vq=w\times r$, vq being the tangential velocity component and w being the angular velocity with unit radians/second and r being the radius, inside the tube 10.

The swirl number as denoted by the ratio of the tangential velocity vq/vr, vr being the radial velocity component will need to be between 0.6–1 at the inlet to the annulus 28. This corresponds to a detailed swirl number $S=Gq/(G\times r)$, Gq being axial flux of angular momentum and Gr being the axial momentum (thrust) of 1–2.5, corresponding to strong swirl. The swirling flow continues downstream along the annulus 28 until it reaches the end wall 17 the fuel inlet tube 16 where the area is increased due to the absence of a central tube 16 and the free vortex thus creates a low pressure region 19 in the downstream volume of the fuel inlet pipe: This pressure is at its minimum in the region in front of the fuel inlet tube 16. The vortex increases in size in the combustion liner 18 due to the expansion in diameter, and a vortex breakdown occurs due to the adverse pressure gradient at the centre. This creates a strong recirculation zone, where burned and partly burned hot exhaust and products gases are recirculated into. Due to the low pressure inside the pilot stage, the hot gases flows inside the tube 10 along the sides of the fuel inlet tube 16. This provides a very stable ignition source for the fresh incoming mixture of fuel and air. The hot gases turns (in a radial direction) as they face the end of the fuel inlet tube 16 and mixes in a shear layer with the fresh air/fuel mixture from the inlet ports 14 and fuel inlet tube 16.

Depending on design, a rich highly strained flame zone in the presence of a "combusting spinning swirl dominated flow" can be achieved inside the tube 10, limited to a thickness of 1–5 mm in the reaction zone. By moving the fuel inlet tube 16 axially, this spinning cylinder which is the onset of combustion, can be tailored to different lengths. The plug 30 is operated for starting of the combustion process.

For gaseous fuels, the fuel enters the annulus 28 through straight drilled orifices 15 in the fuel inlet tube 16. These holes are located at a significant distance from the end portion of the gas inlet tube 16. A typical measure can be 1.5–5 times the diameter of the fuel inlet tube 16 upstream the end. These holes can be arranged in a single or a plurality of hole rows, preferably offset to each other in the case of several rows.

For liquid fuels, a number of orifices positioned at the fuel inlet tube faces the swirling flow in the annulus 28. The orifices are merging into the face of the fuel inlet tube 16, causing the deposition of a film of liquid fuel which is evaporated and finally shedded-off at the sharp edge at the end 17 of the inlet tube 16 as small droplets. As for the gas injection orifices, they are positioned significantly upstream of the central gas inlet tube 10, at 1.5–5 diameters upstream. The droplets are then further vaporised in the swirling flow inside the annulus 28 and the front region 19.

The fuel for the main premixing stage is injected through nozzles on spokes 32 positioned between the guide vanes 31 in the inlet ports 14 as shown in FIG. 2. As mentioned, the radial position of these, as measured from the centerline, can be varied and may not necessarily be symmetrical and at the same radius, to avoid combustion pulsations which is a known problem of LP combustion.

The way in which this invention avoids the traditional problems of poor stability, complex geometry and limited operating range for low emissions is described in the following: The fuel/air mixing by injecting fuel near the wall of the central fuel inlet tube 16 creates a partially premixed mixture which is then ignited by the incoming hot recirculated gases. A part of the flow is thus partially premixed and gives a stable combustion zone in the shear layer. The reaction temperature is lowered due to the recirculation of exhaust gases which acts as a heat sink, the reaction takes place in a highly strained flame which lowers the peak temperature further and broadens the reaction zone delaying the fuel/air reactions. Furthermore, fuel is gradually admixed into the reaction zone from the onset of combustion at the flow stagnation point near the end wall 17 of the fuel inlet tube 16 to the fully expanded flame shape. The flame zone inside the cup 10, is characterised by a "rich combusting spinning swirl dominated flow", with a characteristic diameter of the same order of magnitude as that of the fuel inlet tube 16, and with a reaction zone thickness of 1–5 mm.

There is no contact between this flow and the constraining walls of the tube 10. The mixing process originating from the burner acts as an infinite number of combustion stages, which is beneficial for temperature lowering and combustion control. It is thus achieving the beneficial features of a diffusion flame in terms of stability and range, whereas the emission behaviour resembles that of a lean premixed flame. The stability envelope of the partially premixed stage is very wide due to the unique shape and orientation of the tube 10, the conical restriction 20 and the fuel inlet tube 16 and the nozzles 15.

Figure 3:
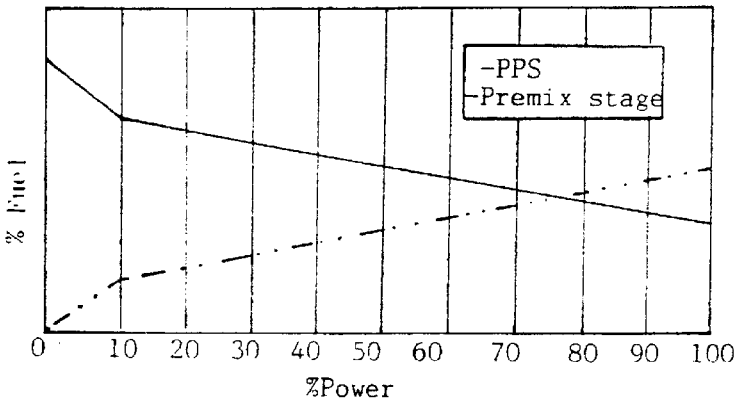
FIG. 3 shows a diagram of the generalised fuel to air ratio split between the diffusion stage and the premix stage at different loads of the burner shown in FIG. 1.

The premixing (main stage) is fed to the combustor through the inlet ports 14, the purpose of this is to mix the fuel with the air so that this stage can operate at the lowest achievable flame temperature. This mixture is ignited in the main combustion liner and forms an integrated flame designated "partially premixed stage" (PPS). The main stage can support a flame at lower fuel/air ratio than a pure premixed flame due to the stability of the PPS, the preheating and the stable ignition source. The main premixing stage will thus be designed to burn at the lowest flame temperature which is achievable without emitting high emissions of CO and UHC. A generalised graph depicting the fuel split between the PPS and the premixing stage is given in FIG. 3. The principle is thus fuel staging and not air staging.

Venturi combustors are inherently unstable, although excellent low emission behaviour can be achieved at a limited load range. A typical venturi combustor configuration is described in Norwegian patent No. 303551. The described configuration is due to the limited volume for flame stabilisation and the short residence time of the secondary venturi not optimal in terms of engine operability and part load emissions behaviour. Thus a venturi combustor in combination with the burner of FIG. 1 is shown in FIGS. 4 and 5.

A venturi burner 40, as mentioned in the previous paragraph, is connected to a cylindrical combustion liner 18, similar to the one shown in FIG. 1, downstream of the restriction 20. The venturi burner 40 is mounted for tangentially injection of fuel/air mixture into the cylindrical combustion liner 18. The flame tube 18 and the housing defines there between annular spaces or channels 42, 44 for the supply of air to the venturi combustor 40.

The combustion air is delivered to the venturi combustor 40 by the gas turbine air compressor (not shown) through said channels and is mixed with fuel in a swirl generating and fuel inlet system as shown in FIGS. 1 and 2. The fuel inlet tube 16 of this embodiment is made an integral part of the end closing dish 27.

Figure 4:
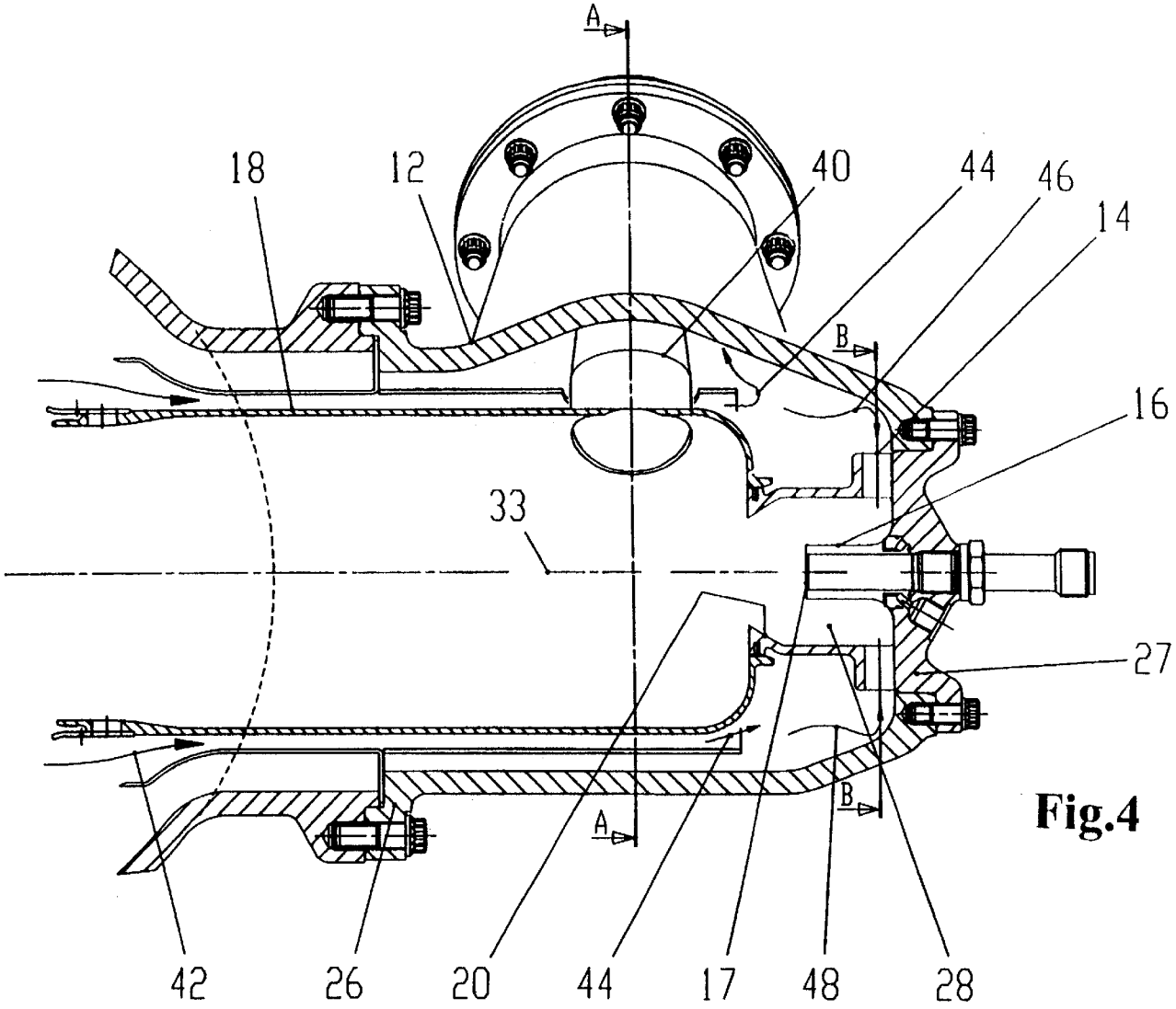
FIG. 4 shows an longitudinal section through a second embodiment of the invention.
Figure 5:
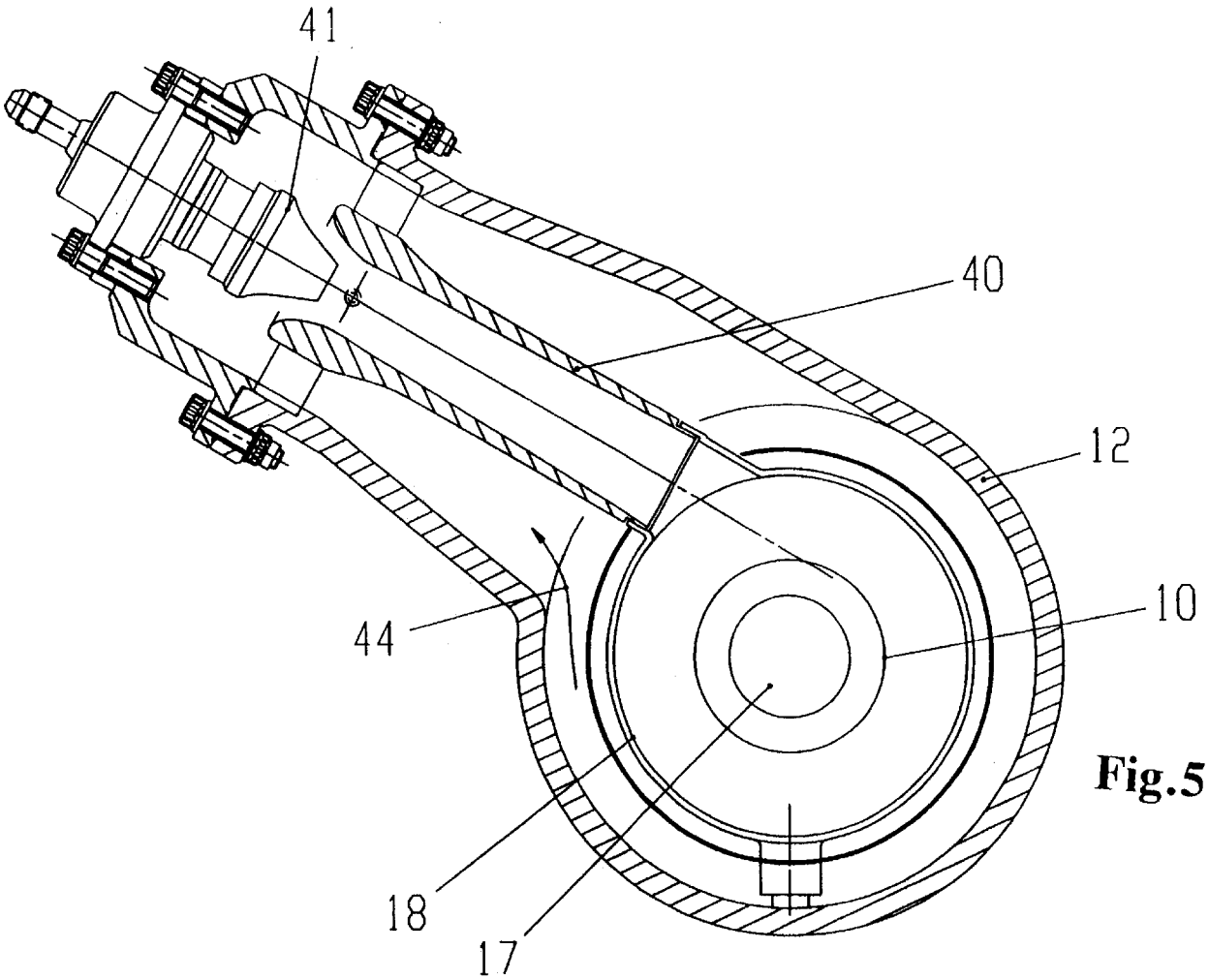
FIG. 5 shows a cross section along the line A—A in FIG. 4.

In the embodiment as depicted in FIG. 4, the central burner operates as a pilot burner, providing stability for the main venturi burner and such stability is provided with the same low emissions as described above. In the operation as a pilot burner the fuel supply will be at least through the PPS stage and as an option also through the premixing stage. By the latter even lower emissions of particularly NOx can be achieved.

The function of the second embodiment is as follows, with reference to FIGS. 4–6. The main premixing stage consists of the venturi premixer 40, mixing the fuel injected by the fuel nozzle 41, the air being pumped to the combustor by the air compressor section of the gas turbine through 42 and 44. The single venturi injects the fuel/air mixture into the cylindrical combustion liner 18 tangentially, creating a strong swirling combusting flow. The fuel preparation is done in such a manner that the mixture is homogeneous and lean in fuel. The pilot stage is equivalent to the above description in FIG. 1 of the first embodiment. The air enters the cylindrical tube at the inlet of this stage where air is being pumped from the engine compressor section through 42, 44 and 46.

The interactions between the rather unstable combustion zone from that of the venturi 40 and the stable combustion from that of the initial burner (the pilot stage) creates a stable combination which will improve the operation of such a combustor significantly in terms of stability, emissions and operational range. The rotational direction of the venturi flow inside the main combustor tube 18 is co-swirling with that of the pilot burner. For simplicity, the further description refers only to fuel being injected in the PPS stage (partially premixed stage) as also shown in the fuel-split graph, FIG. 6.

At low load, the pilot stage carries the whole fuel load, in this situation only air flows through the venturi 40, in FIG. 4. At a certain load the main burner (venturi) 40 is brought into operation. At this point the maximum amount of fuel is injected into the venturi 40 to have as high temperature as possible which the restrictions of about 1900K as upper limit. This will then put arduous conditions to the pilot basic burner as the fuel fraction is low and the pilot will then need to operate under very lean condition. This is where the excellent stability features of the pilot burner can be exploited to the full effect. The pilot burner can support the flame at lower combinations of emissions and fuel to air ratios (FAR) than other known burners. At full load the fuel distribution is tailored to achieve the lowest possible emission rate. The main flow can also operate under leaner conditions than normal due to the stable ignition source generated by the pilot stage. Low emission combustion can thus be achieved and combustion oscillations will be suppressed due to the stability of the pilot combustion process.

Figure 7:
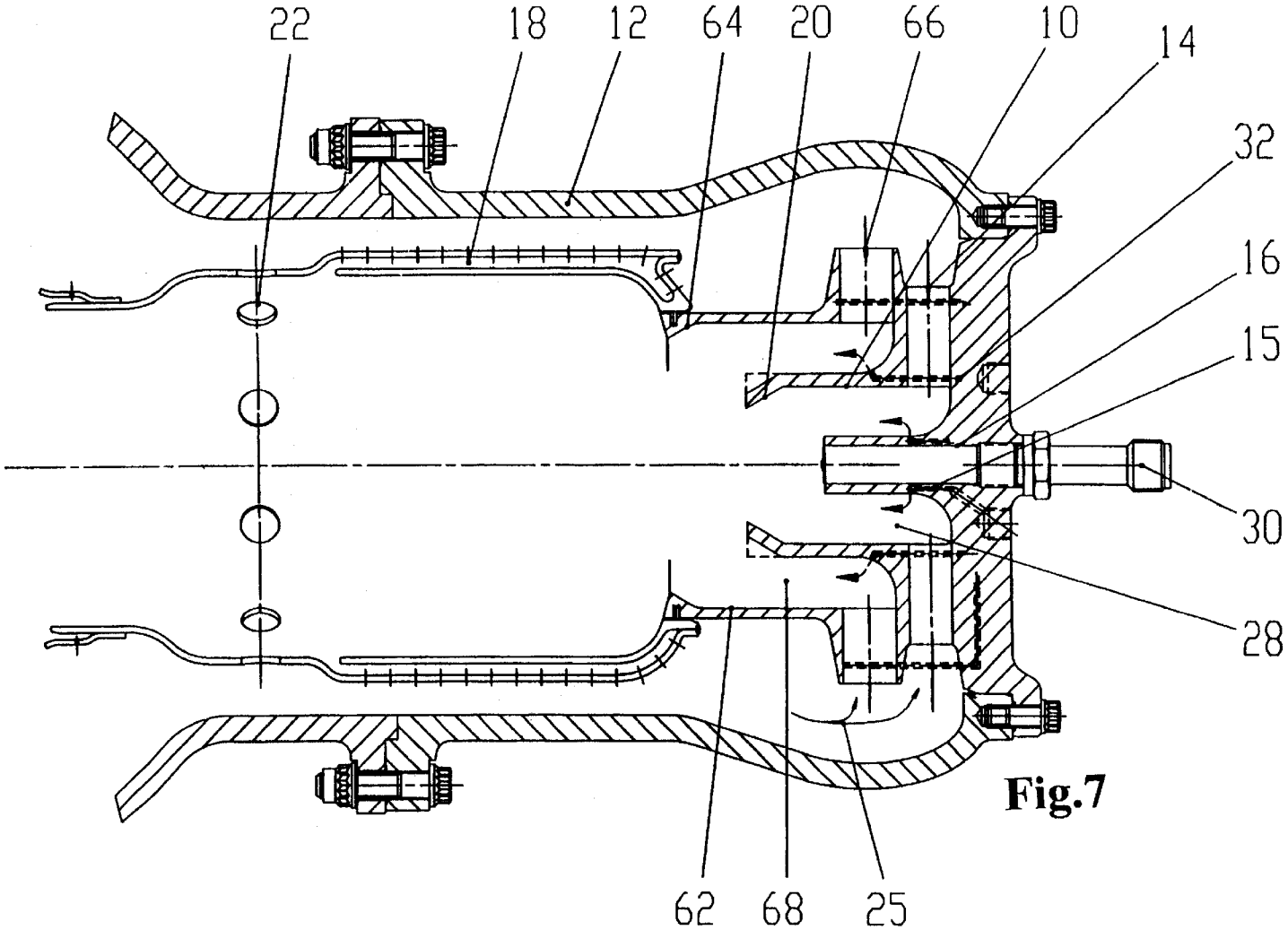

In FIG. 7 a third embodiment is shown. A central pilot burner similar to that of FIGS. 1 and 2 enables to operate as for the former embodiment, as a pilot burner and will have fuel injection in at least the PPS stage. Coaxially mounted and outside the pilot burner, there is arranged a further burner having a tubular element 62 of similar geometry as the tube 10 of the pilot burner, and also including a converging cone restriction 64 extending some further downstream into the combustion liner 18 than the similar converging cone restriction 20 of the internal pilot burner. The mutually coaxial tubular elements 10 and 62 establish a further annular space 68 also positioned coaxially outside of the internal annulus 28.

In the outer tubular element 62, the cup 10 of the basic burner forms and constitutes the central fuel supply similar to the function and shape of central fuel inlet tube 16 disclosed in previous drawing figures.

As for the pilot stage, the upstream end of the tubular element 62 involves air inlets 66 through which air may be injected from the air supply 25. The air inlets 66 are positioned axially downstream of the similar air inlets 14 of the pilot burner. The fuel injection nozzles are designed similar to that of the inlet ports 14 of FIGS. 1 and 2.

Figure 6:
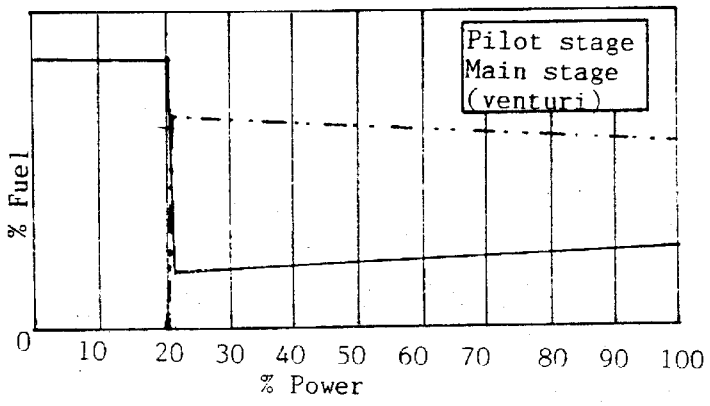
FIG. 6 shows a diagram of the generalized fuel to air ratio split between the pilot burner stage and the secondary (main) premix stage at different loads of a burner according to FIG. 5.

In general, a number of such coaxial stages as shown in FIG. 6 can be arranged.

For particular engine architectures and where the operating range is especially wide and where low emissions are required over the whole operating range of all the previously described emission species, the third embodiment will allow optimum control of these parameters with an added complexity of the design.

The pilot burner of FIG. 7 will have fuel injection in at least the PPS stage.

A burner having a number of the abovementioned coaxial stages, may be beneficial for special circumstances in operating demands (very wide and/or cyclic operation) or for special engine types/applications with decoupled air mass flow and power. The rotational directions of the flows issuing from the pilot burner is preferably co-swirling, i.e same angular direction.

Figure 8:
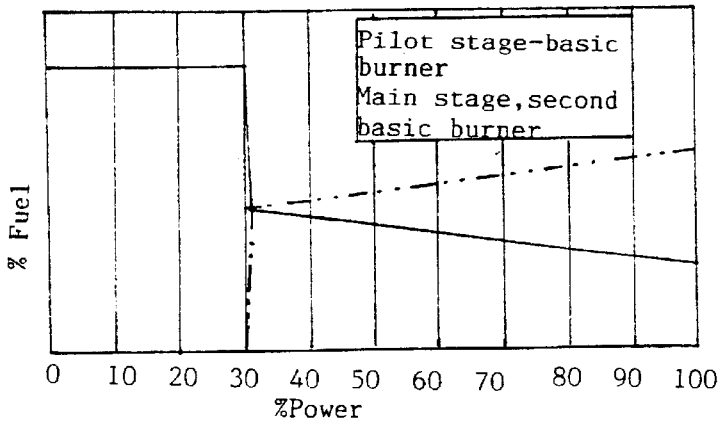
FIG. 8 shows a plot of the generalized fuel to air ratio split between the pilot burner stage and the secondary (main) premix stage at different loads of a burner according to FIG. 7.

Reference is made to FIG. 8 showing the operation of this embodiment in case of a two-stage design, whereas in general an infinite number of stages can be used on the cost of complexity. The pilot burner operates the engine up to a certain load where the main burner is put into operation at a certain fuel distribution level (or FAR). The main burner delivers a homogeneous mixture of fuel and air to the pilot combustion zone (as described in function and operation earlier). Upon contact with the pilot flame, the main flow ignites and bums in a stable configuration, the stability being supplied by the pilot due to hot gases being available for stable ignition of the rather lean mixture coming from the main burner. The premixing in the main burner and the PPS/premixing from the basic burner secures low emissions. The 100% load emissions are tailored in fuel split so that the lowest achievable emissions can be obtained.

For further coaxial stages, the same procedure will be repeated, with a new stage being put into operation at a higher load to a certain fuel distribution and then tailor the final split at full load to minimum emissions can be achieved.

What is claimed is:

1. Device in a burner for gas turbines, comprising a cylindrical housing (10) and a fuel inlet tube (16) arranged centrally within said housing, said housing (10) and fuel inlet tube (16) mutually defining an annular chamber (28), said annular chamber (28) extending into an extended diameter combustion chamber (18), having means (25) for supplying combustion air to said annular chamber (28), radial flow swirlers (14) being provided at this means, for creating a rotational movement of the combustion air in said annular chamber, characterized in that the housing (10) providing the annular chamber (28) has a downstream restriction (20) in front of the free end of the centrally located fuel inlet tube (16), at the entrance of the combustion chamber (18), for creating a rich combustion spinning tubular swirl dominated flow of a mixture of air and fuel, with a recirculation central core, said tubular spinning flow extending into the combustion chamber (18), and that the fuel inlet tube (16) has a multiple of inlet nozzles (15) in an array at a distance from the free end of the tube of at least approximately 1,5 times the diameter of the fuel inlet tube.

2. Device according to claim 1, characterized in that the restriction (20) at the end of the annular chamber (28) is in ratio of 0.6–0.9 of the diameter of the chamber, to create a spinning tubular swirl dominated flow extending into the combustion chamber (18).

3. Device according to claim 1, characterized in that the axial distance of the restriction (20) from the free end of the fuel inlet tube (16) is in the ratio of 0,2–3 of the diameter of said restriction.

4. Device according to claim 1, characterized in that a series of axial spokes (32) with fuel inlet nozzles, said spokes crossing the to annular chamber (28), are arranged at varying radial positions to decouple any pulses of the parallel air inlet elements, for reducing the noise of the burner.

5. Device according to claim 1, characterized in that the downstream sides of the inlet nozzles (15) of the fuel inlet tube (16) are merging into the surface of the inlet tube to provide an exit film of fluid fuel on the surface of the fuel inlet tube.

6. Device according to claim 5, characterized in that the distance of the array of nozzles (15) from the free end of the fuel inlet tube (16) is 1.5–5 times the diameter of the tube.

7. Device according to claim 1, characterized in that a venturi air mixing device (40) is arranged tangentially to the main combustion chamber (18) adjacent the downstream end (20) of the cylindrical housing (10).

8. Device according to claim 1, characterized in that a second housing (62) is coaxially enclosing the first cylindrical housing (10) and extending a distance further in downstream direction, beyond the restricted end portion (20) of the first housing (10), and the downstream end portion of the second housing (62) extending into an inwardly tapering portion (64), defining a cone section (64), said first and second housings (10,62) mutually defining a second annular chamber (68), the upstream end of the second housing (62) comprising means (66) for supplying combustion air or a fuel/air-mixture into the second annular chambers.

9. Device according to claim 1, characterized in that the restriction (20) of the annular chamber (28) has a conical taper.

* * * * *